US005353992A

United States Patent [19]

Regueiro

[11] Patent Number: 5,353,992

[45] Date of Patent: Oct. 11, 1994

[54] MULTI-HOLE INJECTOR NOZZLE TIP WITH LOW HYDRAULIC PLUME PENETRATION AND LARGE CLOUD-FORMING PROPERTIES

[75] Inventor: Jose F. Regueiro, Rochester Hills, Mich.

[73] Assignee: Chrysler Corporation, Highland Park, Mich.

[21] Appl. No.: 112,930

[22] Filed: Aug. 30, 1993

[51] Int. Cl.[5] ..... F02M 61/16

[52] U.S. Cl. ..... 239/533.12; 239/599; 239/601

[58] Field of Search ..... 239/533.3–533.12, 239/601, 599

[56] References Cited

U.S. PATENT DOCUMENTS

| | | | |
|---|---|---|---|
| 4,069,978 | 1/1978 | El Moussa | 239/533.2 |
| 4,699,323 | 10/1987 | Ruh et al. | 239/585.4 |
| 5,163,621 | 11/1992 | Kato et al. | 239/533.12 |
| 5,244,154 | 9/1993 | Buchholz et al. | 239/533.12 |

FOREIGN PATENT DOCUMENTS

| | | | |
|---|---|---|---|
| 404665 | 10/1924 | Fed. Rep. of Germany | 239/533.12 |
| 424321 | 5/1911 | France | 239/533.12 |
| 2229868 | 12/1974 | France | 239/533.2 |
| 222971 | 12/1983 | Japan | 239/533.2 |

*Primary Examiner*—Karen B. Merritt
*Attorney, Agent, or Firm*—Kenneth H. MacLean

[57] ABSTRACT

A fuel injection nozzle assembly (10) for injecting fuel into the combustion chamber of an internal combustion engine. A needle (26) of the nozzle assembly is forced upwardly against the downwardly directed force of a spring (28) by the high pressure of fuel which is fed through a fuel passageway (20). The fuel is forced through nozzle discharge orifices (50) which are in fluid communication with the combustion chamber. Each of the nozzle discharge orifices (50) includes a flow control orifice portion (52) having a circular cross-section which regulates the amount of fuel which passes through the orifices (50) and a connecting dispersing portion (54) which progressively increases in area to break up and disperse the fuel into a cloud-like mist that conforms to the configuration of the combustion chamber so that there be minimized contact with the walls thereof for optimized fuel burns.

2 Claims, 2 Drawing Sheets

FIG-1
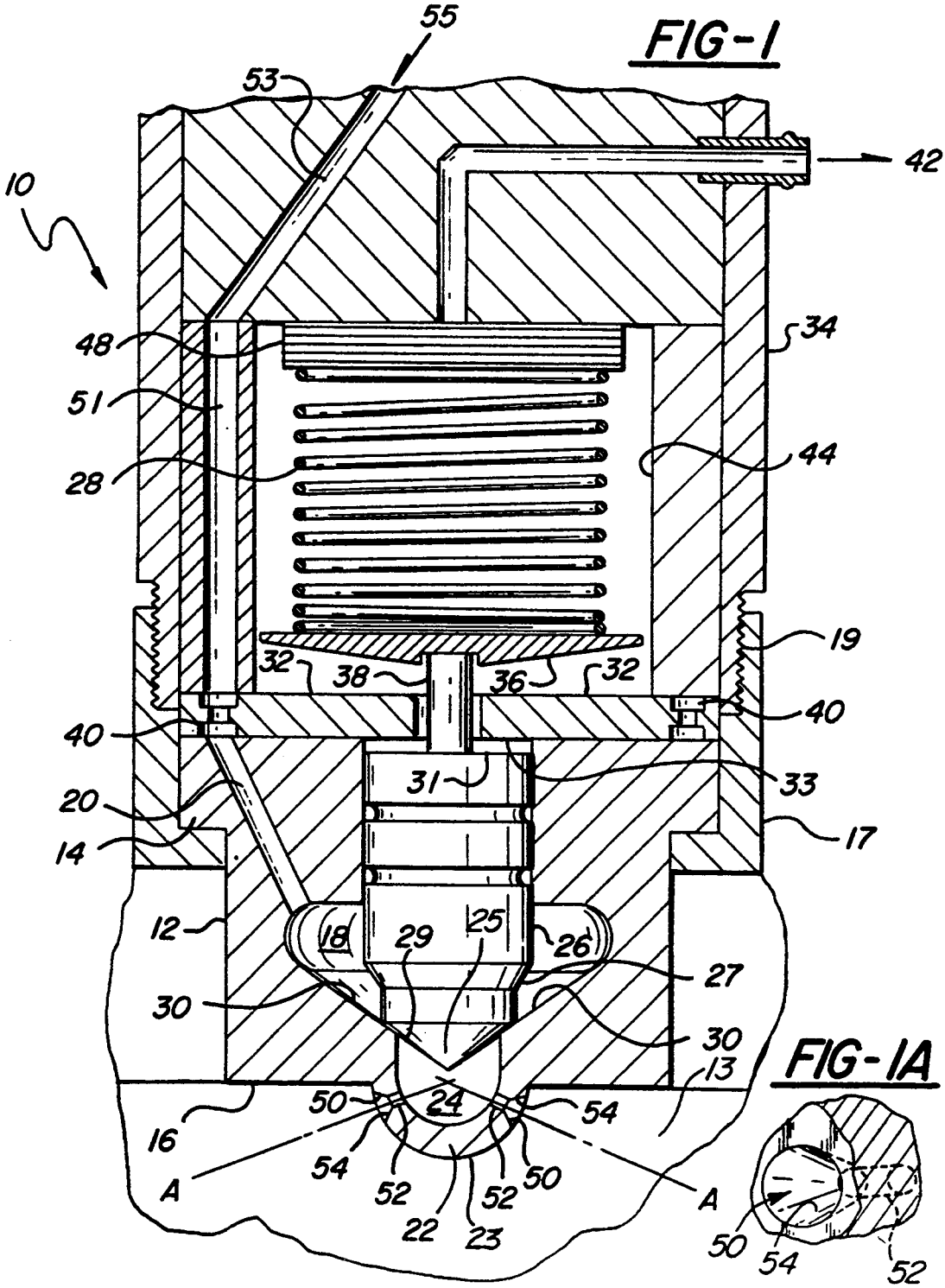
FIG-1A
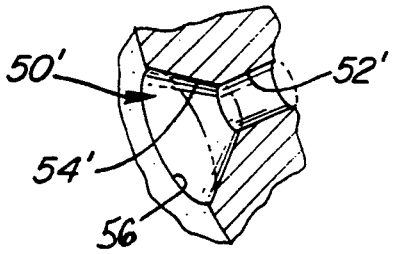
FIG - 4
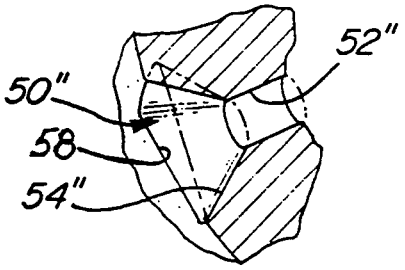
FIG - 5

MULTI-HOLE INJECTOR NOZZLE TIP WITH LOW HYDRAULIC PLUME PENETRATION AND LARGE CLOUD-FORMING PROPERTIES

BACKGROUND ART

Technical Field

The invention relates to fuel injectors and, more particularly, to discharge orifices in the nozzle tips of fuel injectors that disperse fuel evenly as a large volume cloud directly into the combustion chamber of an internal combustion engine.

Background Art

Fuel injection systems have been employed in various engine applications for a wide range of automotive vehicles. These systems employ fuel injectors which inject a stream or plume of atomized fuel into the combustion chambers where power developing ignition occurs. Under some conditions, a portion of the injected fuel impinges onto the side wall of the associated combustion chamber. Since the combustion chamber walls are cooler than the air compressed by the piston, the fuel impinging on the walls cools down and effectively quenches part of what otherwise could have been a good combustion event because either part of the fuel does not burn or it burns very late in the expansion stroke. Such combustion produces objectionable smoke, particulates and hydrocarbons, and decreases engine fuel efficiency and engine performance.

In most open chamber diesel engines, combustion is achieved by imparting a rotary motion often called "swirl" to the air charge about the vertical axis of the piston. The fuel is then injected through a conventional multi-hole or orifice nozzle tip perpendicular to the air motion. In these cases, the injection pressures rarely exceeded 15,000 PSI.

With improved technology, it has been found that by raising the injection pressures in the range of 20,000–24,000 PSI, reducing the discharge orifice sizes and practically eliminating the 'swirl' motion of the air, combustion is greatly improved. This occurs because the air flow into the cylinder improved as 'swirl' is removed, and with higher pressures and smaller orifices, there is better fuel break-up and less combustion chamber plume penetration and, therefore, less impingement on the walls of the combustion chamber, with the fuel forming a better cloud or mist.

These improvements, however, are not without drawbacks. First, the system must be physically capable of higher pressures; second, the smaller size of the cylindrical discharge orifices in the nozzle tip makes them more sensitive to normal diametral manufacturing tolerances; and third, the smaller holes are more prone to coking under certain operating conditions, such as, prolonged cold idling with low injection pressures and misfiring due to cold ambient temperature.

U.S. Pat. No. 4,699,323, issued to Rush et al on Oct. 13, 1987, discloses an orifice director plate having multiple fuel directing orifices or ports which is located downstream in the valve. Once the fuel passes through the fuel director orifices in the director plate, streams of fuel collide to produce two conically diverging fuel spray patterns. Typically two conically diverging spray patterns enter a tubular spray tip before entering the cylinder. Although this nozzle assembly includes a radially, outwardly flared discharge wall, the effect, (i.e. result) of such an outwardly flared discharge wall is minimized by the fact that the tubular spray tip extends well into the conical area defined by the radially outwardly flared discharge wall.

The injector disclosed in the cited Rush et al patent is a low-pressure gasoline injector, approximately 60 PSI maximum, designed to inject fuel in the intake ports of modern four-valve gasoline engines and is not suitable for diesel engines. Its use, now generally accepted and widely used on four-valve gasoline engines, serves to emphasize the need to improve the fuel-air mix by injecting the fuel in a fine misted cone without impinging on cold walls. This gasoline injector, however, will not perform in diesel engines which are designed to operate with very high-pressure injection systems.

SUMMARY OF THE INVENTION AND ADVANTAGES

A fuel injection nozzle tip assembly is disclosed for injecting liquid fuel directly into a combustion chamber of an internal combustion engine, and particularly, compression ignition engines. The fuel injection nozzle tip assembly comprises a nozzle body having a base end and a distal end. The nozzle body defines an interior chamber, a fuel inlet passageway, and an exterior surface. Special nozzle discharge orifices are located at the distal end of the assembly and extend from the interior chamber through the distal end to transmit and effectively generate and distribute an atomized spray of fuel forming mist-like cloud in the combustion cylinder of an internal combustion engine. Each of the nozzle discharge orifices include a cylindrical flow control orifice portion to regulate the amount of fuel which is to pass through the nozzle discharge orifice. Additionally, each nozzle discharge orifice further includes a dispersing portion which extends out from the flow control orifice portion through the distal end and to the exterior surface of the distal end to disperse the fuel uniformly inside the chamber to correspond with the configuration of the chamber.

An important advantage of such a nozzle discharge orifice configuration is the ability to cloud or mist a spray of fuel entering the combustion chamber of an internal combustion engine in a manner so that fuel is efficiently ignited and combusted. More specifically, the misted fuel which is injected into the cylinders of internal combustion engines remains in the air suspended therein forming a wider, less dense cloud for better mixing with the air which has minimized contact the walls of the combustion chamber so that it can more efficiently mix with air to provide more efficient fuel combustion with a reduction in smoke.

Other advantages, object and features of the present invention will be readily appreciated as the same becomes better understood by reference to the following detailed description when considered in connection with the accompanying drawings.

BRIEF DESCRIPTION OF THE DRAWINGS

FIG. 1 is a cross-sectional side view of the preferred embodiment of the subject invention shown as part of a fuel injection valve assembly;

FIG. 1A is an end view of a portion of the nozzle tip of FIG. 1 showing the configuration of the dispensing portion of one of the nozzle discharge orifices;

FIGS. 4 and 5 are fragmentary pictorial views of different configurations of nozzle discharge orifices in the nozzle end of fuel injectors.

DETAILED DESCRIPTION OF THE DRAWINGS

Figure 2:
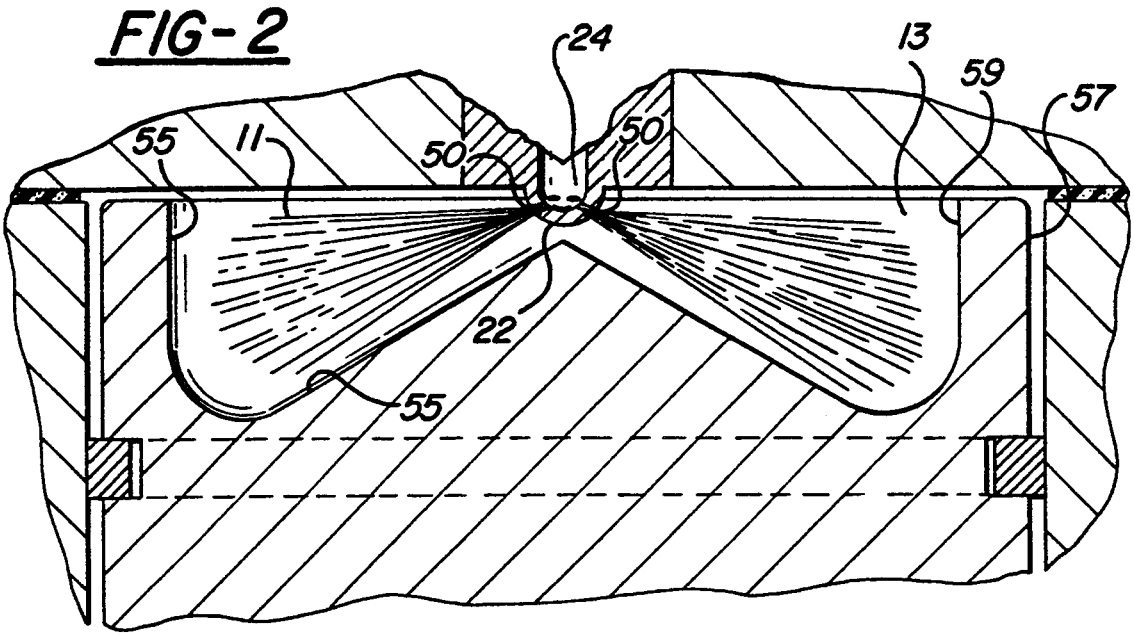
FIG. 2 is a cross-sectional side view of the preferred embodiment of the subject invention shown with a cloud of fuel mist in the combustion chamber.
Figure 3:
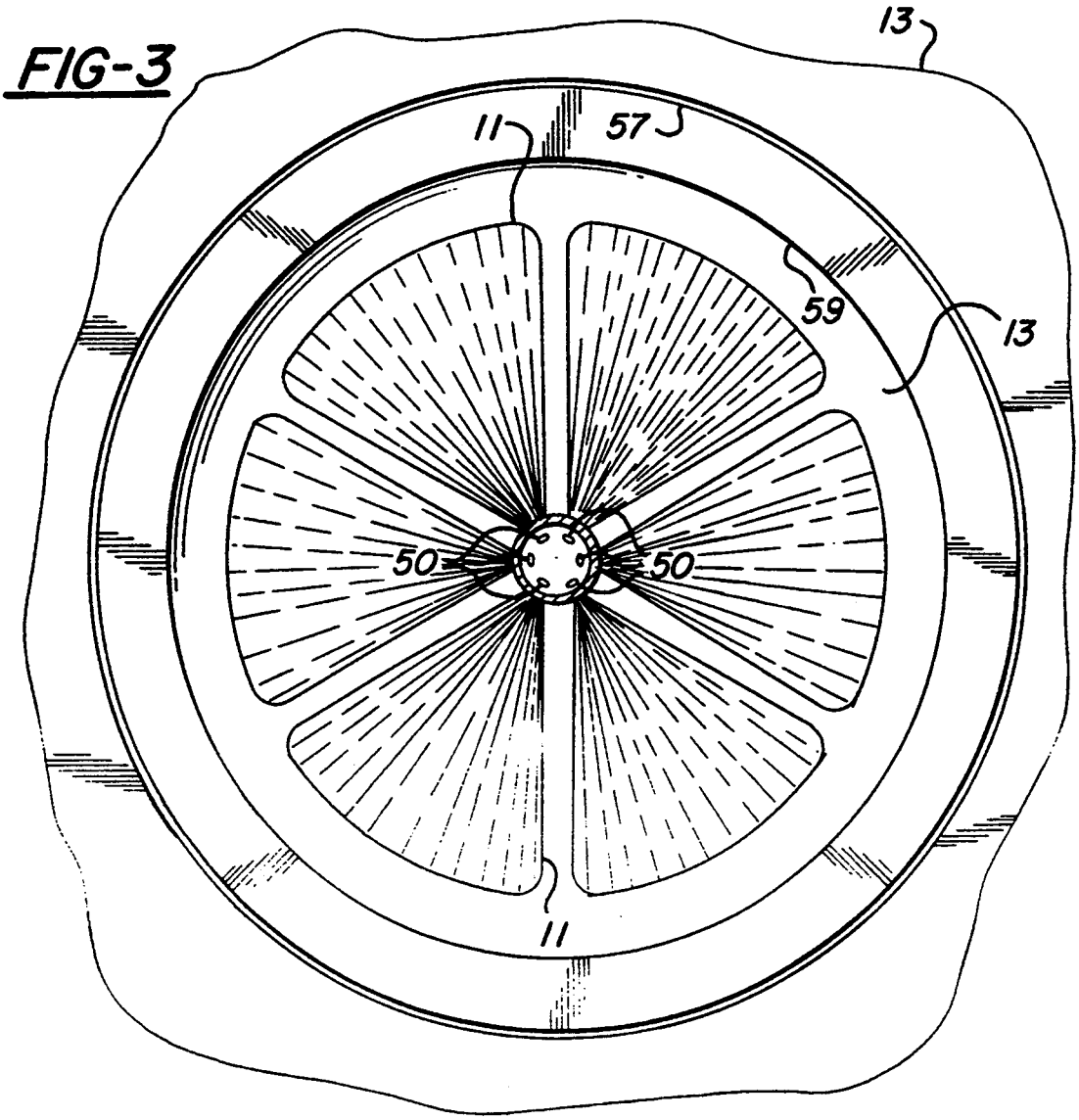
FIG. 3 is a cross-sectional top view of a combustion chamber with cloud formations resulting from the nozzle discharge orifice configuration of FIGS. 1 and 1A.

Referring to the Figures, a fuel injector nozzle tip assembly is generally shown at 10. The fuel injection nozzle tip assembly 10 injects fuel 11 directly into a combustion chamber 13 of a compression-ignition internal combustion engine.

The fuel injection nozzle assembly 10 includes a nozzle tip body 12 having a large diameter upper cylindrical retainer or base end 14 and a reduced diameter distal end or tip shank 16. The nozzle tip body 12 is secured to the body of the nozzle assembly by a tip nut 17, by threaded connection 19 between the external lower end of the holder body 34 and the upper inner wall of the tip nut 17. The nozzle tip body 12 defines a conical interior chamber or sump 18, a fuel inlet passageway 20, and a projecting hemispherical wall 22 defining a portion of a sac hole or volume 24. The hemispherical end wall or protuberance 22 has an exterior surface 23 disposed within combustion chamber 13.

The internal chamber 18 is necessary for proper fluid communication with fuel inlet passageway 20. Additionally, the internal chamber 18 acts as a fluid reservoir to keep the conical head 25 of nozzle tip needle 26 from sagging back onto the seat 29 after it begins to lift. The lifting, due to differential volume action, allows some of the fuel in the internal chamber 18 to pass through the seat 29 and into the sac volume 24, from which the fuel is directed into the combustion chamber 13 through the nozzle discharge orifices 50. The internal chamber 18 also is used as a buffer or heat sink between the hot temperatures of the combustion chamber 13 and the nozzle tip body 12 which prevents overheating of the tip body 12 and the formation of coke at the nozzle discharge orifices 50, the sac volume 24 and at the needle seat 29.

The internal chamber 18 is a fuel inlet chamber that receives fuel from a fuel injection system (not shown). The fuel injection system pulses fuel through the fuel inlet passageway 20 in the ranges typically of 12,000 to 20,000 psi into the inlet chamber 18, once for each engine cycle. The high pressure fuel pulse forces the cylindrical needle 26 upwardly against the force of a downwardly biasing spring 28 by applying pressure against an angled annular shoulder 27 formed on the needle 25 which is subjected to the pump line pressure.

When the pump line pressure, multiplied by the differential annular area afforded by shoulder 27, creates an upwardly directed force which exceeds the opposing biasing force of the spring 28, the needle 26 begins to lift. The spring exerts its force against the needle 26 through the spring base 36 bearing against the needle shank extension 38. When the needle 26 is displaced upward, the conical head 25 thereof is displaced from the mating sealing seat 29 allowing fuel from the interior chamber 18 passes down into the sac volume 24 from which it is forcibly injected into the combustion chamber through the special nozzle discharge orifices shown at 50 in the FIGS. 1 and 2 (two shown).

At the end of the injection period, when the pump cuts off the supply of high pressure fuel, and as the pressure decays in the chamber 18 so that the sum of the product of the decaying line pressure times the differential area provided by shoulder 27 plus the pressure in the sac volume 24 times the tip point area is less than the force of the spring 28, the needle 26 is forced down by the spring 28, and conical head 25 sealingly engages the mating conical seat or sealing surface 29 preventing fuel from entering the sac volume 24, thus ending the flow of fuel through the discharge orifices 50 into the combustion chamber 13.

A stop pad 32 extends between the nozzle holder body 34 of the fuel injection nozzle assembly 10 and the nozzle tip body 12. The stop pad 32 prevents the needle 26 from rising thereabove, thus controlling the lift of the needle 26. A nozzle shank extension or stem 38 extends between the spring base 36 and the needle 26 and through the stop pad 32. The fluid grooves and passages 40 are used to maintain fluid communication between the high pressure supply drillings 51, 53; as shown by the arrow 55 and the rest of the fuel system; not shown. The linear distance between the flat top of the needle 31 and the bottom surface 33 of the stop pad 32 precisely determines the lift of the injector which, in conjunction with the system pressure and discharge orifice areas determines the maximum flow capacity of the injector assembly.

Shims 48 are used to space the spring 28 a distance from the uppermost portion of the spring chamber 44 to provide the proper nozzle opening pressure or valve opening pressure which the spring 28 is to apply downwardly onto the needle 26 to control the beginning of the opening and closing of the needle and thus, injection timing duration.

A fuel leakage return 42 allows fuel to escape which passes the lapped surfaces between the needle 26 and the nozzle tip body 12 and through a spring chamber 44 which houses the spring 28, spring base 36, and the shim pack 48.

The nozzle discharge orifices 50 are located in the hemispherical wall 22 at the distal end of the nozzle provided by tip shank 16. The nozzle discharge orifices 50 extend from the sac chamber 24 through the wall 22 so that fuel from sac chamber 24 can be atomized and distributed as a cloud which progressively increases in cross-sectional area as it charges combustion chamber 13 of defined cross-section of an internal combustion engine.

The nozzle discharge orifices 50 includes a flow control orifice portion 52 whose diameter is restricted to have a flow capacity which controls and regulates the amount of fuel passing therethrough. The flow control orifice portion 52 fed with fuel from sac chamber 24, connects into the partially conical dispersing portion 54 which extends through the exterior surface 23 of the hemispherical wall 22. This partially conical portion progressively opens so that the fuel disperses and atomizes as a cloud inside the combustion chamber. When the fuel flows from the sac volume 24 and is forced through the nozzle discharging orifices 50, the fuel is initially shot through the flow control orifice 52. In the absence of dispersing portion 54, a straight plume of the fuel would be shot through the flow control orifice be straight and delivered deep into the cylinder, impinging on the outside walls of the combustion chamber and rendering ignition and combustion incomplete.

Because dispersing portion 54 transmits fuel from the end of the flow control orifice portion 52 and progressively opens, the fuel dissipates into fine droplets and is dispersed as a large cloud before it reaches deeply into the combustion chamber to wet the walls thereof- The net result of the opened-cone dispersing portion 54 of the illustrated embodiment is the creation of cloud having a cross-section to better match the requirements of the combustion chamber without excessive contact with the cooler walls of the chamber 13. The size and shape of both the flow control orifice portion 52 and the cloud dispersing portion 54 can vary with respect to each other depending on the shape of the combustion chamber 13. In most cases, the flow control orifices portion 52 is cylindrical but the outside shape of the dispensing portion 54 may so that the shape and density of the fuel plume or cloud can best match to the configurations of the combustion chamber. Thus, the cross-section of the plume could either be circular, oval, rectangular or even triangular by appropriately changing the cross-section of the dispensing portion.

More particularly, the fuel injection nozzle assembly 10 is further characterized by the dispersing portion 54 having an exit feeding into the combustion chamber of the cylinder. Because the outer configuration of the dispersing portion is substantially similar and proportional to the cross-section and size of the combustion chamber, fuel will not be directed onto a wall 55 of the piston 57 but will cloud in the interior of the combustion chamber 13. For example, a cylindrical combustion chamber will require a nozzle discharge orifice 50' with a control orifice portion 52' to feed fuel into a dispersing portion 54' having an outer periphery in the shape of a circle or an oval, as shown at 56 in FIG. 4. A rectangular combustion chamber will require a outer periphery substantially similar to a rectangle with the sides being of similar shape or, in the alternative, at least of adequate shape to cover the combustion chamber with a relatively thin sheet of fuel clouded to maximize combustion.

A triangular shaped combustion chamber may require a nozzle discharge orifice 50'' with a cylindrical control orifice portion 52 feeding into the small end of a triangular shaped dispensing orifice portion 54'' having an outer periphery in the shape of a triangle, as shown in FIG. 5.

The nozzle assembly is further characterized by a plurality of nozzle discharging orifices 50 being located at the distal end 16 of the nozzle body 12. As is shown in FIG. 1, at least two nozzle discharging orifices 50 are used to further disperse the fuel as it is projected through the nozzle discharging orifices 50 and because a plurality of nozzle discharging orifices 50 will be directed in different directions, the outer periphery of the dispersing portion 54 may be modified to compensate for such angular injection of the fuel. As can be appreciated, there are normally four or five nozzle discharge orifices 50 per combustion chamber 13, with some very large engines having ten or more orifices.

The plurality of nozzle discharge orifices include longitudinal axes A such that each of the longitudinal axes of each of the nozzle discharge orifice portions 50 define an angle therebetween.

In the preferred embodiment, wherein the subject invention is used in conjunction with cylindrically shaped combustion chambers, the dispersing portions 54 have an interior wall defining a side wall of a frustum shown in FIGS. 1 and 1A. More specifically, the interior wall of the dispersing portion 54 is a portion of a cone wherein the top and bottom of the interior wall of the combustion chamber define planes and, more particularly, the sides 59 of the chamber define circles within those parallel planes.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described. The invention has been described in an illustrative manner, and it is to be understood that the terminology which has been used is intended to be in the nature of words of description rather than of limitation.

What is claimed is:

1. A fuel injector with a fuel discharge nozzle operative to form and radially inject a plurality of clouds of particles of combustible fuel into a combustion chamber of an internal combustion engine, the combustion chamber having a predetermined shape defined in part by a centralized vertical axis and internal cylindrical wall means spaced from and disposed around said axis, said injector comprising:

a nozzle tip body having a distal end wall including a centralized annular protuberance which has an annular exterior surface and which projects into said combustion chamber, said body having a fuel sump and a sac chamber formed therein, a fuel feed passage in said body for transmitting a quantity of fuel into said sump, a second fuel feed passage connecting said sump to said sac chamber and an annular fuel sealing seat in said fuel sump and in said tip body surrounding a portion of said second fuel feed passage, valve element means operatively disposed in said body having a fluid sealing head movable between a first position in which said head is in seating and fluid sealing engagement with said sealing seat so as to block the flow of fuel from said sump into said sac chamber and thereby into said combustion chamber and a second position in which said head is disposed from said valve seat so that fuel can be injected from said sac chamber into said combustion chamber, said annular protuberance having at least four fuel flow controlling and flow directing and cloud forming discharge orifices arcuately spaced from one another and arranged adjacent to one another in a circular path encompassing said protuberance, each of said discharge orifices includes a flow control orifice portion to regulate the amount of fuel passing through said discharge orifice, said flow control orifice portion being a cylindrical passageway extending from said sac chamber to a terminal end within said protuberance space from the exterior surface thereof, each said nozzle discharge orifice further including a fuel dispersing and cloud forming passageway extending with a progressively increasing cross-section directly and outwardly from said terminal end of said flow control orifice portion, said fuel dispersing and cloud forming passageway terminating with an oval shaped opening in said exterior surface of said protuberance to shape the cloud of particles of fuel discharged by the injector, said fuel flow controlling and flow directing and cloud forming discharge orifices extending radially from said sac chamber through said protuberance to form and radially direct said fuel as a plurality of equally shaped clouds of fuel particles toward said cylindrical wall means of said combustion chamber that completely overspread said chamber and combine to match the shape of said chamber with minimized wetting of said wall means of said chamber by said combustible fuel particles thereby improving the combustion thereof within said chamber.

2. A fuel injector with a fuel discharge nozzle operative to form and radially inject a plurality of clouds of particles of combustible fuel into a combustion chamber of an internal combustion engine, the combustion chamber having a predetermined shape defined in part by a centralized vertical axis and internal cylindrical wall means spaced from and disposed around said axis, said injector comprising:

a nozzle tip body having a distal end wall including a centralized annular protuberance which has an annular exterior surface and which projects into said combustion chamber, said body having a fuel sump and a sac chamber formed therein, a fuel feed passage in said body for transmitting a quantity of fuel into said sump, a second fuel feed passage connecting said sump to said sac chamber and an annular fuel sealing seat in said fuel sump and in said tip body surrounding a portion of said second fuel feed passage, valve element means operatively disposed in said body having a fluid sealing head movable between a first position in which said head is in seating and fluid sealing engagement with said sealing seat so as so to block the flow of fuel from said sump into said sac chamber and thereby into said combustion chamber and a second position in which said head is disposed from said valve seat so that fuel can be injected from the said sac chamber into said combustion chamber, said annular protuberance having at least four fuel flow controlling and flow directing and cloud forming discharge orifices arcuately spaced from one another and arranged adjacent to one another in a circular path encompassing said protuberance, each of said discharge orifices includes a flow control orifice portion to regulate the amount of fuel passing through said discharge orifice, said flow control orifice portion being a cylindrical passageway extending from said sac chamber to a terminal end within said protuberance spaced from the exterior surface thereof, each said nozzle discharge orifices further including a fuel dispersing and cloud forming passageway extending with progressively increasing cross-sections outwards from said terminal end of said flow control orifice portion, said fuel dispersing and cloud forming passageway terminating with a triangular shaped opening in said exterior surface of said protuberance to shape the cloud of particles of fuel discharged by the injector, said fuel flow controlling and flow directing and cloud forming discharge orifices extending radially from said sac chamber through said protuberance to form and radially direct said fuel as a plurality of equally shaped clouds of fuel particles toward said cylindrical wall means of said combustion chamber that completely overspread said chamber and combine to match the shape of said chamber with minimized wetting of said wall means of said chamber by said combustible fuel particles thereby improving the combustion thereof within said chamber.

* * * * *